US012427370B2

(12) United States Patent
Luo

(10) Patent No.: US 12,427,370 B2
(45) Date of Patent: Sep. 30, 2025

(54) FOLDABLE TREADMILL

(71) Applicant: Jiangxi EQI Industrial Co. Ltd, Xiushui (CN)

(72) Inventor: Xietong Luo, Xiushui (CN)

(73) Assignee: Jiangxi EQI Industrial Co. Ltd, Xiushui (CN)

( * ) Notice: Subject to any disclaimer, the term of this patent is extended or adjusted under 35 U.S.C. 154(b) by 106 days.

(21) Appl. No.: 18/597,831

(22) Filed: Mar. 6, 2024

(65) Prior Publication Data

US 2025/0213913 A1 Jul. 3, 2025

(30) Foreign Application Priority Data

Dec. 28, 2023 (CN) ..... 202323623730.0

(51) Int. Cl.
*A63B 22/02* (2006.01)
*A63B 21/00* (2006.01)

(52) U.S. Cl.
CPC ..... *A63B 22/02* (2013.01); *A63B 21/4035* (2015.10); *A63B 2210/50* (2013.01)

(58) Field of Classification Search
CPC . A63B 21/4035; A63B 22/0046; A63B 22/02; A63B 26/00; A63B 26/003; A63B 2069/0037; A63B 71/0009; A63B 71/0036; A63B 71/0054; A63B 2071/0072; A63B 2210/00; A63B 2210/50; A63B 2225/09; A63B 2225/093
See application file for complete search history.

(56) References Cited

U.S. PATENT DOCUMENTS

| | | | | |
|---|---|---|---|---|
| 9,168,414 | B2 * | 10/2015 | Liu | A63B 22/02 |
| 11,569,860 | B2 * | 1/2023 | Gu | A47B 23/06 |
| 11,998,796 | B2 * | 6/2024 | Luo | A63B 21/023 |
| 2013/0237381 | A1 * | 9/2013 | Chen | A63B 22/02 482/54 |
| 2014/0076206 | A1 * | 3/2014 | McCabe | F16M 11/046 108/5 |

FOREIGN PATENT DOCUMENTS

| | | | | |
|---|---|---|---|---|
| CN | 201088804 | Y * | 7/2008 | A63B 22/02 |
| CN | 108619662 | A * | 10/2018 | A63B 22/02 |
| CN | 108785985 | A * | 11/2018 | A63B 22/02 |
| CN | 113996007 | A * | 2/2022 | A63B 22/02 |
| CN | 113996007 | B * | 10/2022 | A63B 22/02 |

(Continued)

*Primary Examiner* — Gary D Urbiel Goldner
(74) *Attorney, Agent, or Firm* — Andrew C. Cheng

(57) ABSTRACT

A foldable treadmill includes a treadmill body, a pillar assembly, a storage frame, and a storage platform. The storage platform is detachably installed on the storage frame. The pillar assembly includes two pillars. A bottom end of each pillar is rotatably connected to a front end of the treadmill body, and the storage frame is rotatably connected to the two pillars. When the foldable treadmill is in an unfolded state, the pillar assembly stays in a standing position, and the storage frame stays in a horizontal position and is used to install the storage platform. When the foldable treadmill is in a folded state, the storage platform is removed from the storage frame, the storage frame is rotated to be in a same plane as the pillar assembly, and both the storage frame and the pillar assembly are rotated to be stored on sides of the treadmill body.

17 Claims, 12 Drawing Sheets

(56) References Cited

FOREIGN PATENT DOCUMENTS

| | | | | | |
|---|---|---|---|---|---|
| CN | 115445142 | B | * | 8/2023 | ..... A63B 22/025 |
| CN | 116785643 | A | * | 9/2023 | ..... A63B 22/02 |
| CN | 117339167 | A | * | 1/2024 | ..... A63B 22/02 |
| CN | 108785985 | B | * | 6/2024 | ..... A63B 22/02 |
| TW | 201028187 | A | * | 8/2010 | |

* cited by examiner

FOLDABLE TREADMILL

TECHNICAL FIELD

The present application relates to the technical field of treadmill structure, and in particular, to a foldable treadmill.

BACKGROUND

A treadmill is a commonly used fitness equipment in homes and gyms, which generally comes in two types: fixed and foldable. Specifically, the pillars, handrails and other components of the foldable treadmill can be folded up when not in use, making it convenient for transportation and storage. Therefore, foldable treadmills have become the preferred choice for household treadmills.

In order to facilitate users to listen to music and watch videos while running, and to increase the fun of running, some existing treadmills have storage platforms for electronic devices such as mobile phones, tablets and so forth. For a foldable treadmill, setting up a storage platform on the treadmill will make it difficult to be folded. Therefore, current treadmills with a storage platform (especially when the volume of the storage platform is relatively large) are generally fixed-type treadmills, and the storage platform is fixed on the treadmill.

In view of above, it is necessary to design a foldable treadmill that can be easily folded and has a storage platform.

SUMMARY

The object of the present application is to provide a foldable treadmill, which is provided with a storage platform, capable of storing items such as mobile phones, tablets and so forth, and has a folding function, thus making it convenient to use.

The present application provides a foldable treadmill, including a treadmill body, a pillar assembly, a storage frame, and a storage platform, wherein the storage platform is detachably installed on the storage frame; the pillar assembly includes two pillars located on the left and right sides of the treadmill body, the bottom end of each pillar is rotatably connected to the front end of the treadmill body, and the storage frame is rotatably connected to the top ends of the two pillars;

when the foldable treadmill is in an unfolded state, the pillar assembly stays in a standing position, the storage frame stays in a horizontal position and is used to install the storage platform; when the foldable treadmill is in a folded state, the storage platform is removed from the storage frame, the storage frame is rotated to be in the same plane as the pillar assembly, and both the storage frame and the pillar assembly are rotated to be stored on the sides of the treadmill body.

In an achievable manner, the storage frame is a U-shaped structure, and the storage frame includes a crossbar and two side bars respectively connected to the opposite ends of the crossbar, the two side bars are respectively rotatably connected to the top ends of the two pillars;

when the foldable treadmill is in the unfolded state, the storage frame, the pillar assembly and the treadmill body form a Z-shaped structure; when the foldable treadmill is in the folded state, the crossbar is stored on the rear side of the treadmill body, and the two pillars and the two side bars are stored on the left and right sides of the treadmill body.

In an achievable manner, a receiving groove is enclosed by the crossbar and the two side bars; when the storage platform is installed on the storage frame, the storage platform covers the receiving groove; when the storage platform is removed from the storage frame, the receiving groove is exposed.

In an achievable manner, the storage platform includes a storage board and a back plate that is rotatably connected to the storage board, there is an indentation on the storage board; when the back plate is in use, the back plate is rotated and unfolded at a certain angle with respect to the storage board, and when the back plate is not in use, the back plate is rotated to be accommodated and stored in the indentation.

In an achievable manner, the storage platform is provided with a clamping mechanism, and the clamping mechanism is used to engage with the storage frame to fix the storage platform on the storage frame.

In an achievable manner, the clamping mechanism includes a clamping slot provided on the lower surface of the storage platform and clamping claws rotatably connected to the storage platform, the clamping claws are arranged on the left and right sides of the storage platform; when the storage platform is installed on the storage frame, the crossbar is engaged in the clamping slot, and the clamping claws are respectively hooked on the two side bars.

In an achievable manner, the foldable treadmill further includes a hinge assembly, the hinge assembly includes a rotating assembly and a fixing assembly, the bottom end of the pillar is fixedly connected to the rotating assembly, the fixing assembly is fixedly connected to the treadmill body, the rotating assembly is rotatably connected to the fixing assembly, so that the rotating assembly can rotate relative to the fixing assembly;

a first limiting structure is provided on the rotating assembly, and a second limiting structure is provided on the fixing assembly, the second limiting structure is used to cooperate with and abut against the first limiting structure to limit the pillar in position when the pillar is in an unfolded or folded state.

In an achievable manner, the hinge assembly further includes a switch configured for locking and unlocking the rotating assembly, the switch is movably connected to the fixing assembly; when the pillar is in the unfolded state, the switch is engaged with the rotating assembly to lock and maintain the pillar in the unfolded state.

In an achievable manner, the fixing assembly includes a hollow base and a first shaft fixedly connected to the base, one end of the first shaft is fixedly connected to the treadmill body, and the other end of the first shaft extends into the base;

the rotating assembly includes a second shaft and a limiting member, the second shaft is located on one side of the base, the second shaft is fixedly connected to the bottom end of the pillar; the second shaft is rotatably connected to the first shaft through a pin, the limiting member is located inside the base, the limiting member is sleeved on the first shaft, and the limiting member is fixedly connected to the pillar and can rotate with the pillar;

the first limiting structure is provided on the outer wall of the limiting member, the second limiting structure is provided on the inner wall of the base, and the second limiting structure is located on the rotation path of the first limiting structure.

In an achievable manner, the first limiting structure includes a first limiting portion and a second limiting portion that are separately provided on the outer wall of the limiting member, the second limiting structure includes a first stopping portion and a second stopping portion that are separately provided on the inner wall of the base; when the pillar is in the unfolded state, the first limiting portion abuts against one side of the first stopping portion; when the pillar is in the folded state, the second limiting portion abuts against the other side of the first stopping portion, and at the same time, the first limiting portion abuts against the second stopping portion.

In an achievable manner, the limiting member is a circular plate structure, both the first limiting portion and the second limiting portion are formed by protruding radially outward from the outer wall of the limiting member; the base is a circular structure, and both the first stopping portion and the second stopping portion are formed by protruding radially inward from the inner wall of the base.

In an achievable manner, the pin is fixedly connected to the first shaft, and the second shaft is rotatable around the pin; or the pin is fixedly connected to the second shaft, and the pin is rotatably connected to the first shaft.

In an achievable manner, the pin includes a rod and a stopping portion which are interconnected to each other, with the outer diameter of the stopping portion greater than that of the rod, the rod is inserted into both the second shaft and the first shaft, one end of the rod that is far away from the stopping portion is fixedly connected to the first shaft, and the second shaft can rotate around the rod.

In an achievable manner, a through hole is provided in the second shaft, the through hole runs axially through the second shaft, a mounting hole is axially provided in the first shaft; the rod is inserted into the mounting hole after passing through the through hole, the inner wall of the mounting hole is provided with a first step, the outer wall of the rod is provided with a second step, and the second step abuts against the first step.

In an achievable manner, the mounting hole includes a first inner hole and a second inner hole which are interconnected with each other, with the first inner hole located on one side of the second inner hole near the second shaft, wherein the diameter of the first inner hole is greater than that of the second inner hole, and the first step is formed between the first inner hole and the second inner hole; the rod includes a first rod section and a second rod section which are interconnected to each other, the first rod section is located between the stopping portion and the second rod section, the outer diameter of the first rod section is greater than that of the second rod section, and the second step is formed between the first rod section and the second rod section, the second rod section is received in the second inner hole, one end of the first rod section near the second rod section is received in the first inner hole, and the other end of the first rod section that is away from the second rod section is received in the through hole.

In an achievable manner, the hinge assembly further includes a switch configured for locking and unlocking the rotating assembly, the switch is rotatably connected to the base; the switch includes a locking portion and a handle portion which are interconnected to each other, the locking portion is located inside the base, and the handle portion extends to the outside of the base; the limiting member is provided with a limiting groove, when the pillar is in the unfolded state, the locking portion is engaged with the limiting groove to lock and maintain the pillar in the unfolded state.

In an achievable manner, an installation opening configured to install the limiting member into the base is provided on one side of the base facing the second shaft, there is a cover plate located at the installation opening and fixedly connected to the base, the limiting member is received in the space enclosed by the base and the cover plate.

In an achievable manner, a third limiting structure is provided on the storage frame, and a fourth limiting structure is provided on the top end of the pillar; the fourth limiting structure is used to cooperate with and abut against the third limiting structure to limit the storage frame in position when the storage frame is in an unfolded or folded state.

In an achievable manner, a first connecting member is provided on the end of the side bar of the storage frame, a second connecting member is provided on the top end of the pillar, the first connecting member is rotatably connected to the second connecting member through a rotation shaft, the third limiting structure is provided on the first connecting member, and the fourth limiting structure is provided on the second connecting member.

In an achievable manner, the second connecting member includes a first clamping plate and a second clamping plate which are oppositely disposed and spaced apart from each other, the first connecting member is located between the first clamping plate and the second clamping plate, the fourth limiting structure includes a first locking post and a second locking post which are spaced apart from each other and arranged between the first clamping plate and the second clamping plate, the third limiting structure includes a first locking groove and a second locking groove which are provided on the first connecting member, the first locking post and the second locking post can be respectively locked in the first locking groove and the second locking groove.

In an achievable manner, the limiting member is fixedly connected to the pillar through at least one connecting rod, one end of the connecting rod is fixedly connected to the pillar, and the other end of the at least one connecting rod is fixedly connected to the limiting member.

In an achievable manner, the base is provided with a rotating shaft, and the switch is rotatably connected to the base through the rotating shaft; the rotating shaft is sleeved with a gasket, and the gasket abuts against the switch.

In an achievable manner, a corrugated gasket is sleeved on the pin, and the corrugated gasket abuts against one end face of the second shaft that is away from the first shaft.

In an achievable manner, a first nylon gasket is sleeved on the pin, and the first nylon gasket is clamped between the second shaft and the outer wall of the cover plate, a second nylon gasket and a third nylon gasket are sleeved on the first shaft, wherein the second nylon gasket is clamped between the inner wall of the cover plate and the limiting member, and the third nylon gasket is clamped between the limiting member and the inner wall of the base.

The foldable treadmill provided in this application is provided with a storage frame and a storage platform. The storage frame is rotatably connected to the pillar assembly, and the storage platform is detachably installed on the storage frame. When unfolding the foldable treadmill, the pillar assembly is rotated to stay in a standing position, and the storage frame is rotated to a horizontal position, so that the foldable treadmill is in an unfolded state. At this time, the storage platform can be installed on the storage frame, and the users can place items such as mobile phones, tablets and so forth on the storage platform to achieve the storage function of the treadmill. When folding the foldable treadmill, the storage platform is first removed from the storage frame, and then, the storage frame and the pillar assembly are rotated to the sides of the treadmill body to store the storage frame and the pillar assembly, thereby achieving the folding and storage function of the treadmill. Moreover, during the folding process, the storage frame is rotated to be in the same plane as the pillar assembly, thereby reducing the space occupied by the storage frame in the folded state and facilitating folding. This foldable treadmill is not only provided with a storage platform that can hold items such as mobile phones, tablets and so forth, but also has a folding function, making it convenient for the users to use.

DETAILED DESCRIPTION OF THE EMBODIMENTS

Figure 1:
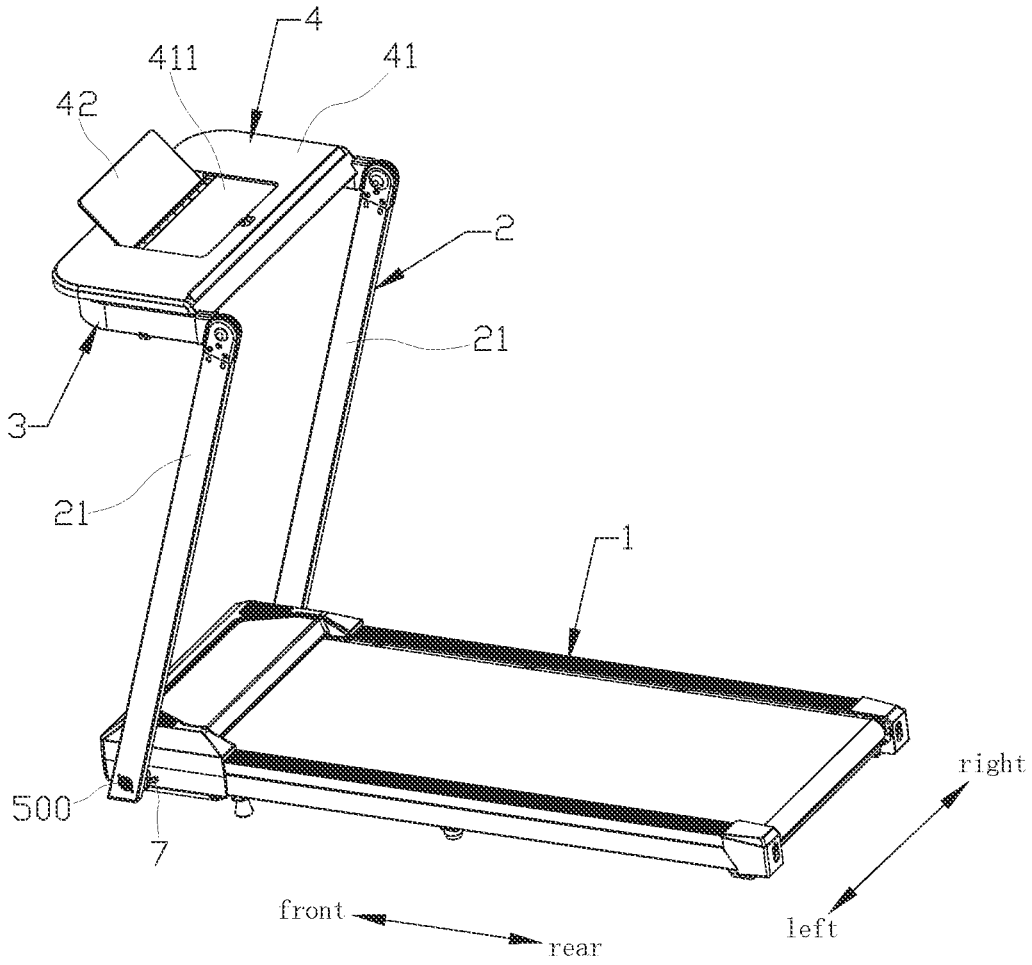
FIG. 1 is a schematic diagram of the structure of the foldable treadmill in the unfolded state in an embodiment of the present application.

The following will provide a further detailed description of the specific implementations of the present application in conjunction with the accompanying drawings and embodiments. The following embodiments are used to illustrate the present application, but are not intended to limit the scope of the present application.

The terms "first", "second", "third", "fourth", etc. (if any) in the specification and claims of the present application are only used to distinguish similar objects, and are not intended to be used to describe a specific sequence or order.

The terms "up", "down", "left", "right", "front", "back", "top", "bottom" (if any) in the specification and claims of the present application are defined based on the position of the structure in the figures and the position between the structures in the figures, only for the clarity and convenience of expressing the technical solution. It should be understood that the use of these directional words should not limit the scope of protection in the present application.

As shown in FIGS. 1 to 5, the foldable treadmill provided in an embodiment of the present application includes a treadmill body 1, a pillar assembly 2, a storage frame 3, and a storage platform 4. The storage platform 4 is detachably installed on the storage frame 3. The pillar assembly 2 includes two pillars 21 respectively located on the left and right sides of the treadmill body 1. The bottom end of each pillar 21 is rotatably connected to the front end of the treadmill body 1, while the storage frame 3 is rotatably connected to the top ends of the two pillars 21, so that both the pillar assembly 2 and the storage frame 3 can be unfolded and folded.

Figure 2:
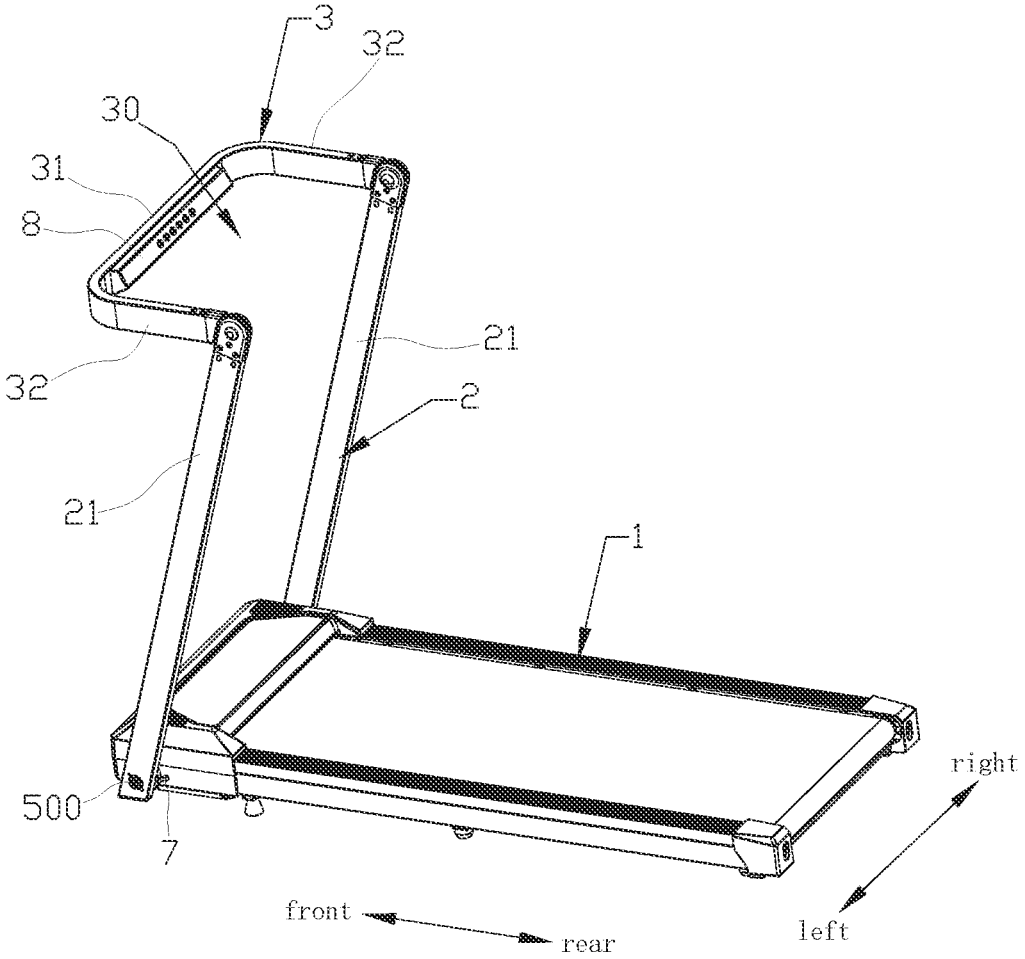
FIG. 2 is a schematic diagram of the structure of FIG. 1 after removing the storage platform.
Figure 3:
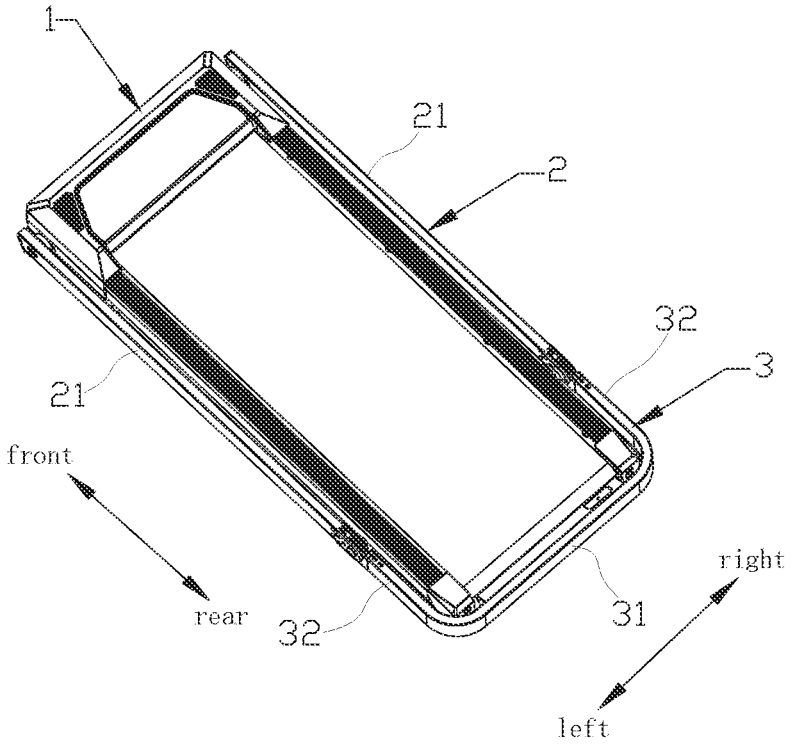
FIG. 3 is a schematic diagram of the structure of the foldable treadmill in the folded state in the embodiment of the present application.

This foldable treadmill has unfolded and folded states. As shown in FIGS. 1 and 2, when the foldable treadmill is in the unfolded state, the pillar assembly 2 stays in a standing position (that is, the pillar assembly 2 is in a vertical state, or the pillar assembly 2 is upright and inclined at a certain angle from the vertical direction), the storage frame 3 stays in a horizontal position and is used to install the storage platform 4 (of course, when no items need to be placed, the storage platform 4 can also be removed from the storage frame 3), and there is a certain angle between the storage frame 3 and the pillar assembly 2. As shown in FIG. 3, when the foldable treadmill is in the folded state, the storage platform 4 is removed from the storage frame 3, and the storage frame 3 is rotated to be in the same plane as the pillar assembly 2 (that is, the plane where the storage frame 3 is located and the plane where the pillar assembly 2 is located are in the same plane), and both the storage frame 3 and the pillar assembly 2 are rotated to be stored on the sides of the treadmill body 1 so as to be kept in the folded state.

The foldable treadmill provided in this embodiment is provided with a storage frame 3 and a storage platform 4. The storage frame 3 is rotatably connected to the pillar assembly 2, and the storage platform 4 is detachably installed on the storage frame 3. When unfolding the foldable treadmill, the pillar assembly 2 is rotated to stay in a standing position, and the storage frame 3 is rotated to a horizontal position, so that the foldable treadmill is in an unfolded state. At this time, the storage platform 4 can be installed on the storage frame 3, and the users can place items such as mobile phones or tablets (or water bottles, keys, and other personal items) on the storage platform 4 to achieve the storage function of the treadmill. When folding the foldable treadmill, the storage platform 4 is first removed from the storage frame 3, and then, the storage frame 3 and the pillar assembly 2 are rotated to the sides of the treadmill body 1 to store the storage frame 3 and the pillar assembly 2, thereby achieving the folding and storage function of the treadmill. Moreover, during the folding process, the storage frame 3 is rotated to be in the same plane as the pillar assembly 2, thereby reducing the space occupied by the storage frame 3 in the folded state and facilitating folding. This foldable treadmill is not only provided with a storage platform 4 that can hold items such as mobile phones, tablets and so forth, but also has a folding function, making it convenient for the users to use.

It should be noted that some existing foldable treadmills also have a phone stand, but in order to facilitate the folding of the phone stand, the phone stand is generally set very small and only used for temporary storage of the phones, and cannot accommodate other items or large items. However, this embodiment improves the functionality of the foldable treadmill by setting up a storage frame 3 and a storage platform 4, wherein various different or large items can be placed on the storage platform 4, making it convenient for the users to use.

As shown in FIGS. 1 to 3, in an achievable manner, the storage frame 3 is a U-shaped structure. The storage frame 3 includes a crossbar 31 and two side bars 32 respectively connected to the opposite ends of the crossbar 31. The crossbar 31 extends along the left-to-right direction of the foldable treadmill, and each side bar 32 extends along the front-to-rear direction of the foldable treadmill. The two side bars 32 are respectively rotatably connected to the top ends of the two pillars 21, that is, one end of each side bar 32 is fixedly connected to the crossbar 31, and the other end of each side bar 32 is rotatably connected to the top end of one pillar 21.

As shown in FIGS. 1 and 2, when the foldable treadmill is in the unfolded state, the storage frame 3 is in a horizontal position, and the top end of the pillar 21 is tilted backwards compared to its bottom end. The storage frame 3, the pillar assembly 2, and the treadmill body 1 form a Z-shaped structure (that is, the storage frame 3 is located on the front side of the top end of the pillar assembly 2). This setting can reduce the upper space occupied by the storage frame 3 and the storage platform 4 on the treadmill body 1, improve the space utilization of the treadmill body 1, and facilitate users to run on the treadmill body 1. As shown in FIG. 3, when the foldable treadmill is in the folded state, the crossbar 31 is stored on the rear side of the treadmill body 1 (that is, the crossbar 31 is located at the rear side of the treadmill body 1 and near the rear sidewall of the treadmill body 1), and the two pillars 21 and the two side bars 32 are respectively stored on the left and right sides of the treadmill body 1 (that is, one pillar 21 and one side bar 32 are located on the left side of the treadmill body 1 and near the left sidewall of the treadmill body 1, while the other pillar 21 and the other side bar 32 are located on the right side of the treadmill body 1 and near the right sidewall of the treadmill body 1). This setting can facilitate the folding of the storage frame 3 and the pillar assembly 2, and minimize the space occupied by the storage frame 3 and the pillar assembly 2 in the folded state.

As shown in FIGS. 1 and 2, in an achievable manner, a receiving groove 30 is enclosed by the crossbar 31 and the two side bars 32. When the storage platform 4 is installed on the storage frame 3, the storage platform 4 is received in the receiving groove 30 and covers the receiving groove 30, and at this time, the storage frame 3 cannot fold (if the storage frame 3 folds at this time, the storage platform 4 will interfere with the rear end of the treadmill body 1 and cannot be folded properly). When the storage platform 4 is removed from the storage frame 3, the receiving groove 30 is exposed, and at this time, the storage frame 3 can be folded normally.

Figure 4:
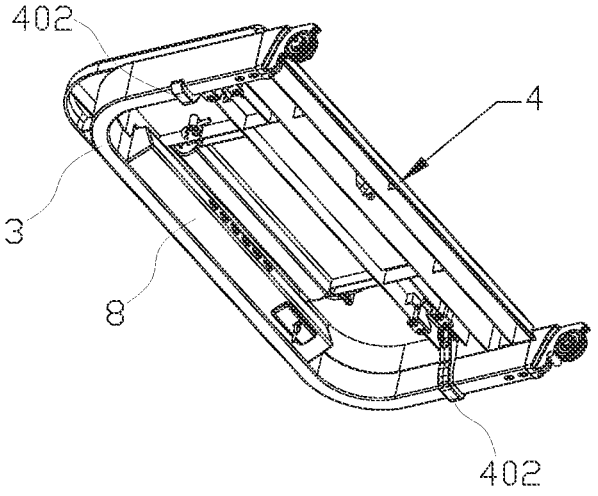
FIG. 4 is a schematic diagram of the assembly structure of the storage platform and the storage frame in the embodiment of the present application.
Figure 5:
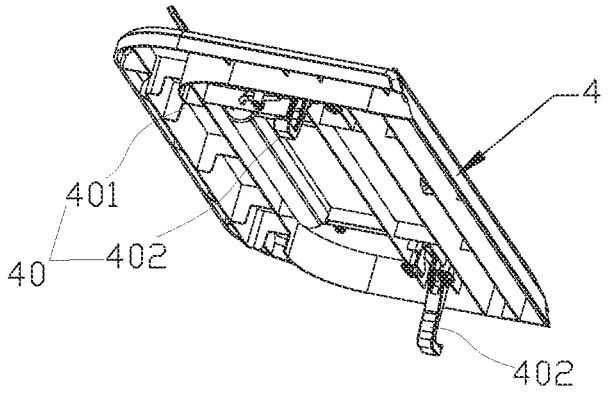
FIG. 5 is a schematic diagram of the structure of the storage platform in the embodiment of the present application.
Figure 6:
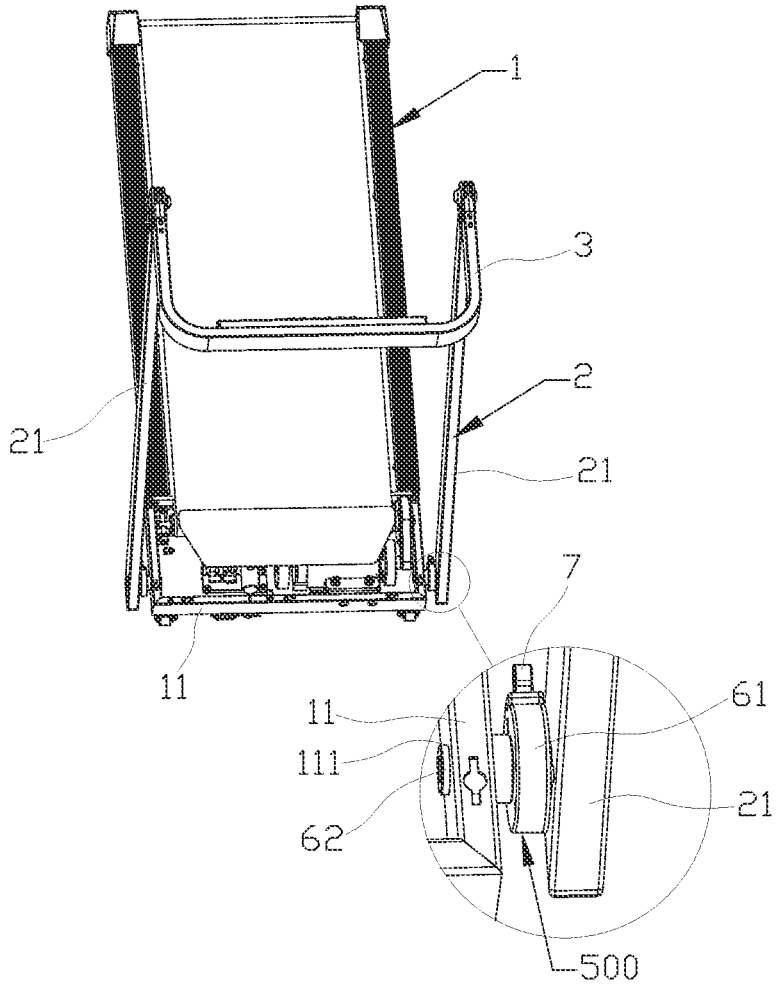
FIG. 6 is a schematic diagram of the assembly structure of the hinge assembly and the treadmill body in the embodiment of the present application.
Figure 7:
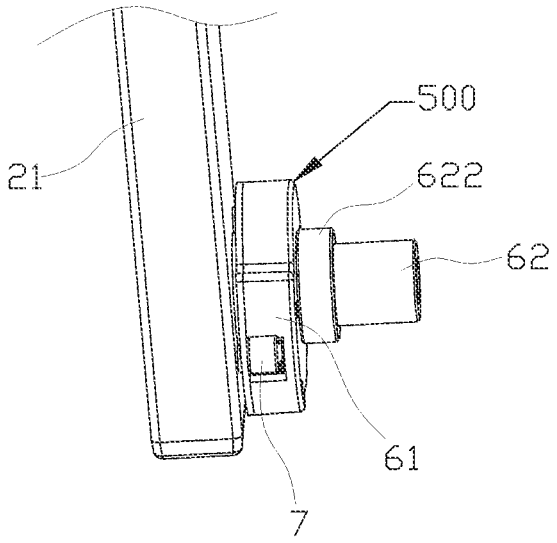
FIG. 7 is a schematic diagram of the assembly structure of the hinge assembly and the pillar in the embodiment of the present application.
Figure 8:
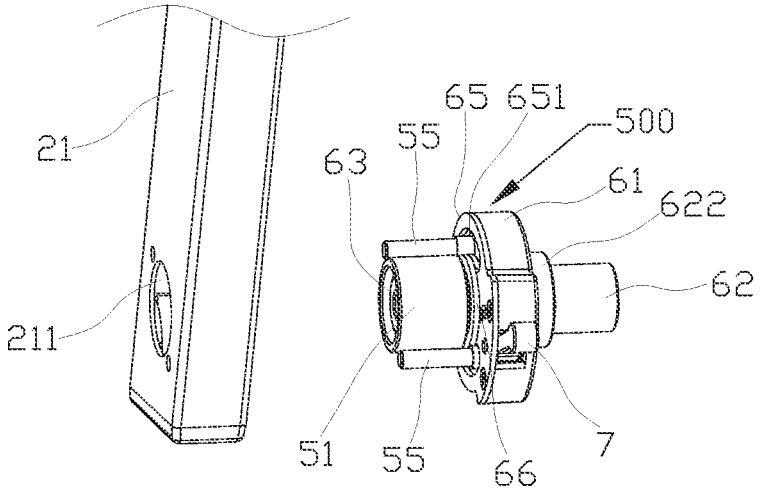
FIG. 8 is a schematic diagram of the explosive structure in FIG. 7.
Figure 9:
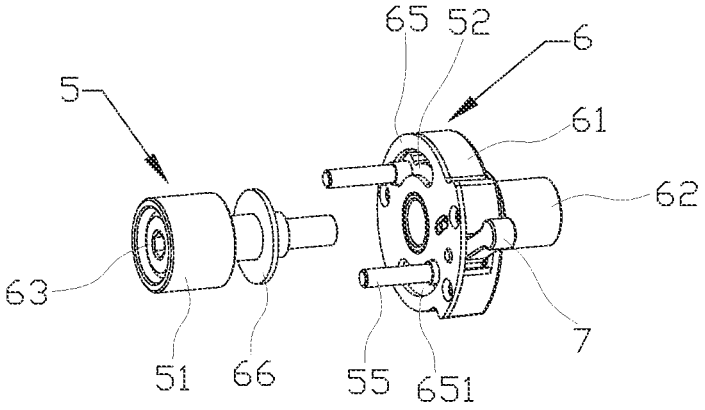
FIG. 9 is a schematic diagram of the explosive structure of the hinge assembly in FIG. 8.

As shown in FIGS. 2, 4, and 5, in an achievable manner, the storage platform 4 is provided with a clamping mechanism 40. The clamping mechanism 40 is used to engage with the storage frame 3 to fix the storage platform 4 on the storage frame 3, thereby facilitating the disassembly and installation of the storage platform 4.

As shown in FIGS. 4 and 5, in an achievable manner, the clamping mechanism 40 includes a clamping slot 401 provided on the lower surface of the storage platform 4 and clamping claws 402 rotatably connected to the storage platform 4. The clamping claws 402 are arranged on the left and right sides of the storage platform 4. When the storage platform 4 is installed on the storage frame 3, the crossbar 31 is engaged in the clamping slot 401, and the clamping claws 402 on the left and right sides are respectively hooked on the two side bars 32, thereby fixing the storage platform 4 on the storage frame 3. When the storage platform 4 is removed from the storage frame 3, the clamping claws 402 on the left and right sides are first rotated to separate them from the side bars 32, and then the storage platform 4 can be removed from the storage frame 3. Of course, in other embodiments, the clamping mechanism 40 can also be other clamping structures.

In another achievable manner, the storage platform 4 and the storage frame 3 are connected by magnetic attraction to achieve detachable connection therebetween. Specifically, magnetic blocks (not shown, such as magnetic steel, magnets, etc.) can be installed on the storage platform 4, the storage frame 3 is made of metal material that can be attracted to the magnetic blocks, and the magnetic blocks are used to attract the storage frame 3 to achieve the installation between the storage platform 4 and the storage frame 3. Alternatively, a first magnetic block is installed on the storage platform 4, a second magnetic block is installed on the storage frame 3, and by using the first magnetic block to attract the second magnetic block, the storage platform 4 can be more stably installed on the storage frame 3.

As shown in FIG. 1, in an achievable manner, the storage platform 4 includes a storage board 41 and a back plate 42 that is rotatably connected to the storage board 41. When the back plate 42 is in use, the back plate 42 can be rotated and unfolded at a certain angle with respect to the storage board 41 (as shown in FIG. 1, the back plate 42 is in an unfolded state). At this time, the back plate 42 can be used to support mobile phones, tablets, etc. There is an indentation 411 on the storage board 41, and when the back plate 42 is not in use, the back plate 42 can be rotated to be accommodated and stored in the indentation 411.

As shown in FIG. 2, in an achievable manner, there is a control panel 8 on the storage frame 3, and the control panel 8 is connected to the treadmill body 1 by signals. The control panel 8 includes multiple control buttons (e.g., switch button, speed control button, motion mode control button, etc.) thereon, which are used by the user to control the actions of the treadmill body 1.

As shown in FIGS. 6 to 9, in an achievable manner, the foldable treadmill further includes a hinge assembly 500, and the bottom end of the pillar 21 is rotatably connected to the treadmill body 1 through the hinge assembly 500. The hinge assembly 500 includes a rotating assembly 5 and a fixing assembly 6. The bottom end of the pillar 21 is fixedly connected to the rotating assembly 5, and the fixing assembly 6 is fixedly connected to the treadmill body 1. The rotating assembly 5 is rotatably connected to the fixing assembly 6, so that the rotating assembly 5 can rotate relative to the fixing assembly 6, thereby achieving the rotational connection between the pillar 21 and the treadmill body 1.

As shown in FIGS. 9 to 13*b*, in an achievable manner, a first limiting structure 53 is provided on the rotating assembly 5, and a second limiting structure 64 is provided on the fixing assembly 6. The second limiting structure 64 is used to cooperate with and abut against the first limiting structure 53, so that the rotating assembly 5 cannot continue to rotate after rotating to a specific position, so as to limit the pillar 21 in position in the unfolded or folded state, and prevent the pillar 21 from continuing to rotate, thereby enabling the pillar 21 to stay in the unfolded or folded state.

As shown in FIGS. 9 to 13*b*, in an achievable manner, the hinge assembly 500 further includes a switch 7 configured for locking and unlocking the rotating assembly 5. The switch 7 is movably connected to the fixing assembly 6. When the pillar 21 is in the unfolded state, the switch 7 is engaged with the rotating assembly 5 to lock the rotating assembly 5, so that the pillar 21 is maintained in the unfolded state to prevent the pillar 21 from rotating and folding on its own during use. When the switch 7 is manually turned, the rotating assembly 5 is unlocked, and the rotating assembly 5 can rotate, allowing the pillar 21 to be rotated and folded.

As shown in FIGS. 8 to 13*b*, in an achievable manner, the fixing assembly 6 includes a hollow base 61 and a first shaft 62 fixedly connected to the base 61. One end of the first shaft 62 is located outside the base 61 and fixedly connected to the treadmill body 1, and the other end of the first shaft 62 extends into the base 61.

The rotating assembly 5 includes a second shaft 51 and a limiting member 52. The second shaft 51 is located on one side of the base 61, and the second shaft 51 is fixedly connected to the bottom end of the pillar 21. The second shaft 51 is arranged coaxially with the first shaft 62, the second shaft 51 is rotatably connected to the first shaft 62 through a pin 63. The limiting member 52 is located inside the base 61, and the limiting member 52 is sleeved on the first shaft 62. The limiting member 52 is fixedly connected to the pillar 21 and can rotate with the pillar 21.

The first limiting structure 53 is provided on the outer wall of the limiting member 52, the second limiting structure 64 is provided on the inner wall of the base 61, and the second limiting structure 64 is located on the rotation path of the first limiting structure 53, so that when the limiting member 52 rotates with the pillar 21, the first limiting structure 53 on the limiting member 52 can abut against the second limiting structure 64 on the inner wall of the base 61 to limit the pillar 21 in position when the pillar 21 is in the unfolded or folded state.

Figure 10:
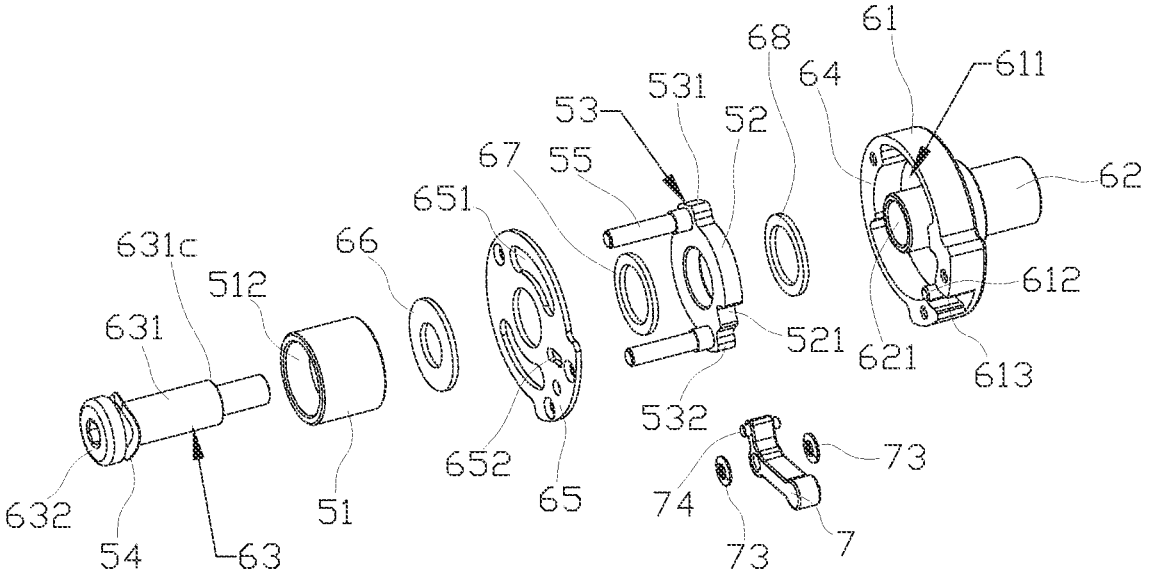
FIG. 10 is a schematic diagram of the explosion structure of FIG. 9 after being further disassembled.
Figure 11:
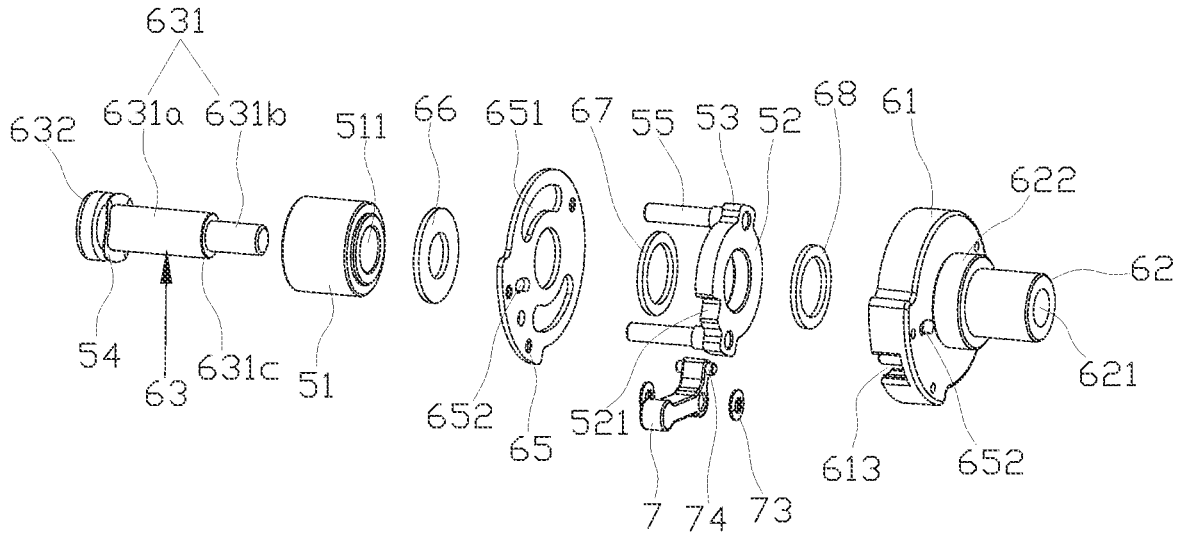
FIG. 11 is a schematic diagram of the structure of FIG. 10 from another perspective.
Figure 12:
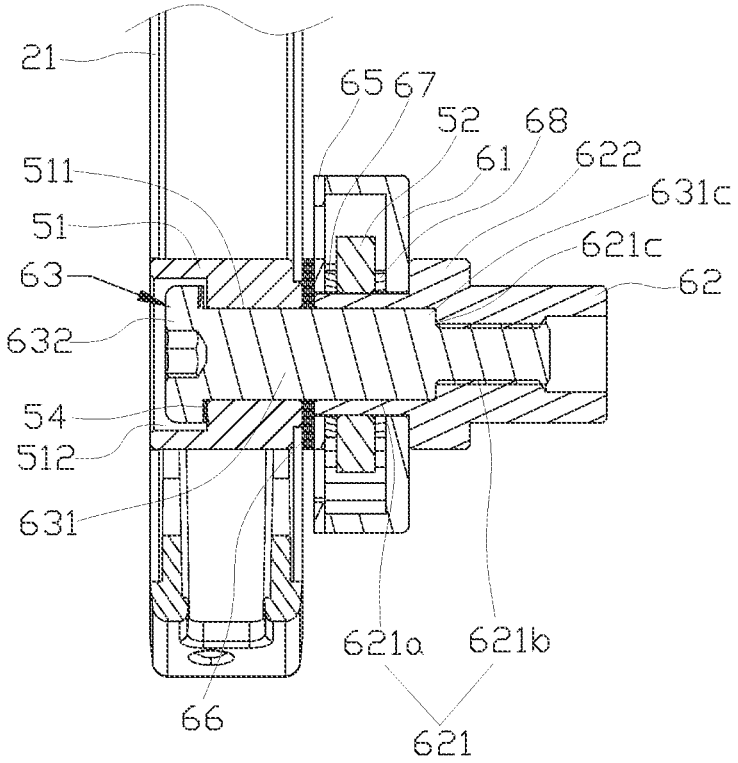
FIG. 12 is a cross-sectional schematic diagram of FIG. 7.

As shown in FIGS. 10 to 12, in an achievable manner, both the first shaft 62 and the second shaft 51 are cylindrical structures. The second shaft 51 is located on one end of the first shaft 62 along the axial direction of the second shaft 51. The pin 63 is fixedly connected to the first shaft 62, and the second shaft 51 is rotatable around the pin 63, thereby achieving a rotational connection between the second shaft 51 and the first shaft 62. Of course, in other embodiments, the pin 63 is fixedly connected to the second shaft 51, and the pin 63 is rotatably connected to the first shaft 62.

As shown in FIGS. 6 to 8 and 12, in an achievable manner, the bottom end of the pillar 21 is provided with a first hole 211, and the second shaft 51 is inserted into the first hole 211. The second shaft 51 is fixedly connected to the pillar 21 by welding.

The treadmill body 1 includes a body frame 11 and a running platform (not labelled) on the body frame 11. The body frame 11 is provided with a second hole 111, and one end of the first shaft 62 is inserted into the second hole 111. The first shaft 62 is fixedly connected to the body frame 11 by welding. The other end of the first shaft 62 extends into the base 61 and is fixedly connected with the base 61 by welding. On the outer wall of the first shaft 62, there is a protruding portion 622, and the protruding portion 622 is clamped between the base 61 and the body frame 11 (that is, the two sides of the protruding portion 622 respectively abut against the side wall of the base 61 and the side wall of the body frame 11), thereby achieving the positioning of the first shaft 62 and facilitating installation, increasing the welding area between the first shaft 62 and the body frame 11 and the base 61, and improving connection stability.

As shown in FIGS. 10 to 13*b*, in an achievable manner, the first limiting structure 53 includes a first limiting portion 531 and a second limiting portion 532 that are separately provided on the outer wall of the limiting member 52. Specifically, in this embodiment, the limiting member 52 is a circular plate structure. The first limiting portion 531 and the second limiting portion 532 are respectively formed on opposite sides of the limiting member 52 along its radial direction. Both the first limiting portion 531 and the second limiting portion 532 are formed by protruding radially outward from the outer wall of the limiting member 52. The second limiting structure 64 includes a first stopping portion 641 and a second stopping portion 642 that are separately provided on the inner wall of the base 61. Specifically, in this embodiment, the base 61 is a circular structure, and both the first stopping portion 641 and the second stopping portion 642 are formed by protruding radially inward from the inner wall of the base 61.

Figure 13A:
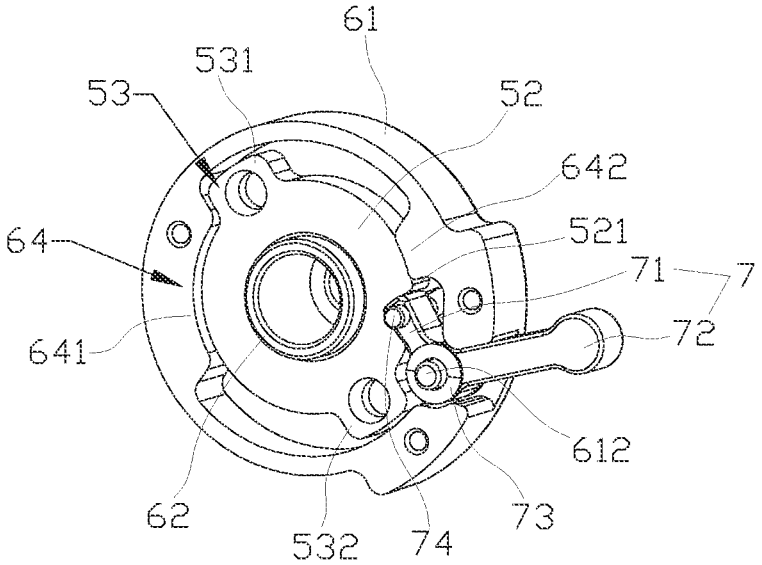
FIG. 13*a* is a schematic diagram of the cooperating relationship between the first limiting structure and the second limiting structure when the pillar is in an unfolded state in the embodiment of the present application.
Figure 13B:
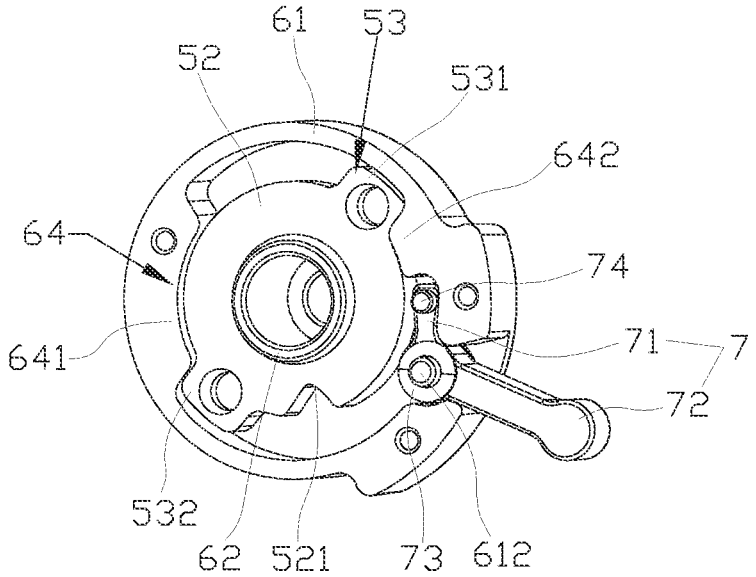
FIG. 13*b* is a schematic diagram of the cooperating relationship between the first limiting structure and the second limiting structure when the pillar is in a folded state in the embodiment of the present application.

As shown in FIG. 13*a*, when the pillar 21 is in the unfolded state, the first limiting portion 531 abuts against one side of the first stopping portion 641, causing the limiting member 52 and the pillar 21 to be unable to continue rotating, thereby limiting the pillar 21 in position when it is in the unfolded state. As shown in FIG. 13*b*, when the pillar 21 is in the folded state, the second limiting portion 532 abuts against the other side of the first stopping portion 641, and at the same time, the first limiting portion 531 abuts against the second stopping portion 642, so that the limiting member 52 and the pillar 21 is unable to continue rotating, thereby limiting the pillar 21 in position when it is in the folded state. Of course, in other embodiments, the first limiting structure 53 and the second limiting structure 64 may also be other forms of structures.

As shown in FIGS. 9 to 12, in an achievable manner, an installation opening 611 is provided on one side of the base 61 facing the second shaft 51, and the installation opening 611 is used to install the limiting member 52 and other components into the base 61. The limiting member 52 is installed into the base 61 from the installation opening 611. There is a cover plate 65 located at the installation opening 611 and fixedly connected to the base 61, so as to cover the base 61 and prevent the internal parts of the base 61 from loosening or coming out. The limiting member 52 is received in the space enclosed by the base 61 and the cover plate 65. Specifically, the cover plate 65 can be fixedly connected to the base 61 through a screw connection.

As shown in FIGS. 8 to 11, in an achievable manner, the limiting member 52 is fixedly connected to the pillar 21 through a connecting rod 55. One end of the connecting rod 55 is fixedly connected to the pillar 21, and the other end of the connecting rod 55 is fixedly connected to the limiting member 52, so that the limiting member 52 can rotate with the pillar 21. Specifically, in this embodiment, there are two connecting rods 55, one end of the two connecting rods 55 is connected to the first limiting portion 531 and the second limiting portion 532 respectively, and the other end of the two connecting rods 55 is connected to the pillar 21. Specifically, there is a hole (not labelled) provided on the pillar 21 for the insertion of the connecting rod 55. At the same time, there is an avoidance hole 651 corresponding to the position of the connecting rod 55 on the cover plate 65. The avoidance hole 651 is specifically an arc-shaped structure. The connecting rod 55 passes through the avoidance hole 651, and the connecting rod 55 can rotate in the avoidance hole 651 to avoid affecting the normal rotation of the connecting rod 55 and the limiting member 52.

As shown in FIGS. 10 to 13*b*, in an achievable manner, the switch 7 is rotatably connected to the base 61. The switch 7 includes a locking portion 71 and a handle portion 72 which are interconnected to each other. The locking portion 71 is located inside the base 61, and the handle portion 72 extends to the outside of the base 61. There is a cutout 613 on the base 61 for the handle portion 72 to extend out. A limiting groove 521 for engaging with the locking portion 71 is provided on the limiting member 52. When the pillar 21 is in the unfolded state, the locking portion 71 is engaged in the limiting groove 521 to lock and maintain the pillar 21 in the unfolded state. Specifically, the handle portion 72 is used for users to manually turn the switch 7 to lock or unlock the switch 7.

Specifically, as shown in FIG. 13*a*, when the pillar 21 is in the unfolded state, the first limiting portion 531 abuts against the first stopping portion 641, the switch 7 is turned to cause the locking portion 71 of the switch 7 to engage in the limiting groove 521 of the limiting member 52, and at this time, the limiting member 52 cannot rotate counter-clockwise or clockwise, thus locking the limiting member 52 in the current position and locking the pillar 21 in the unfolded state. As shown in FIG. 13*b*, when the switch 7 is turned in the opposite direction, the locking portion 71 of the switch 7 is disengaged from the limiting groove 521 of the limiting member 52, and the limiting member 52 is unlocked, so that the limiting member 52 can rotate clockwise (as viewed from FIG. 13*b*), and the pillar 21 can rotate and fold. Of course, in other embodiments, the switch 7 can also be in other forms of structure. For example, the switch 7 can be set as a structure that is slidably connected to the base 61, and locking and unlocking can be achieved by utilizing the sliding movement of the switch 7.

As shown in FIGS. 10 to 13*b*, in an achievable manner, the base 61 is provided with a rotating shaft 612, and the switch 7 is rotatably connected to the base 61 through the rotating shaft 612. The rotating shaft 612 is sleeved with a gasket 73, and the gasket 73 abuts against the switch 7. The gasket 73 is used to increase the rotational resistance of the switch 7, not only providing users with a damping feel when rotating the switch 7, but also preventing the switch 7 from rotating and unlocking on its own under external vibration (if no gasket 73 is provided, the switch 7 can rotate flexibly, and the switch 7 may rotate and unlock on its own due to vibration during use, allowing the pillar 21 to rotate on its own, thereby increasing the danger of use).

As shown in FIGS. 10 to 13*b*, in an achievable manner, gaskets 73 are provided on opposite sides of the switch 7. The gasket 73 on one side is clamped between the cover plate 65 and the switch 7, and the gasket 73 on the other side is clamped between the inner wall of the base 61 and the switch 7, thereby further increasing the rotational resistance of the switch 7. The gasket 73 can specifically be a concave gasket.

As shown in FIGS. 10 to 13*b*, in an achievable manner, both the base 61 and the cover plate 65 are provided with arc-shaped holes 652, and limiting posts 74 are provided on opposite sides of the switch 7. The limiting post 74 on one side is inserted into the arc-shaped hole 652 of the base 61 and can rotate in the arc-shaped hole 652, while the limiting post 74 on the other side is inserted into the arc-shaped hole 652 of the cover plate 65 and can rotate in the arc-shaped hole 652, thereby limiting the rotation path of the switch 7 and improving its rotational stability.

As shown in FIGS. 9 to 12, in an achievable manner, the pin 63 includes a rod 631 and a stopping portion 632 which are interconnected to each other, with the outer diameter of the stopping portion 632 greater than that of the rod 631. The second shaft 51 and the first shaft 62 are both cylindrical structures. The rod 631 is inserted into both the second shaft 51 and the first shaft 62. One end of the rod 631 that is far away from the stopping portion 632 is fixedly connected to the first shaft 62, and the second shaft 51 can rotate around the rod 631. The stopping portion 632 is located on one end of the second shaft 51 that is away from the first shaft 62.

As shown in FIGS. 9 to 12, in an achievable manner, a through hole 511 is provided in the second shaft 51, and the through hole 511 runs axially through the second shaft 51. A mounting hole 621 is axially provided in the first shaft 62. The rod 631 is inserted into the mounting hole 621 after passing through the through hole 511. The inner wall of the mounting hole 621 is provided with a first step 621*c*, the outer wall of the rod 631 is provided with a second step 631*c*, and the second step 631*c* abuts against the first step 621*c*.

Specifically, in this embodiment, the mounting hole 621 includes a first inner hole 621*a* and a second inner hole 621*b* which are interconnected with each other, with the first inner hole 621*a* located on one side of the second inner hole 621*b* near the second shaft 51. The diameter of the first inner hole 621*a* is greater than that of the second inner hole 621*b*, and the first step 621*c* is formed between the first inner hole 621*a* and the second inner hole 621*b*. The rod 631 includes a first rod section 631*a* and a second rod section 631*b* which are interconnected to each other. The first rod section 631*a* is located between the stopping portion 632 and the second rod section 631*b*. The outer diameter of the first rod section 631*a* is greater than that of the second rod section 631*b*, and the second step 631*c* is formed between the first rod section 631*a* and the second rod section 631*b*. The second rod section 631*b* is received in the second inner hole 621*b*, one end of the first rod section 631*a* near the second rod section 631*b* is received in the first inner hole 621*a*, and the other end of the first rod section 631*a* that is away from the second rod section 631*b* is received in the through hole 511. Since the second step 631*c* abuts against the first step 621*c*, therefore, during assembly, the first step 621*c* and the second step 631*c* can play a role in stopping and positioning, which is not only convenient for installation, but also prevents the pin 63 from excessively compressing the second shaft 51 and the first shaft 62 to affect the normal rotation of the second shaft 51.

As shown in FIGS. 9 to 12, in an achievable manner, the rod 631 is provided with an external thread (not shown) on the outer wall corresponding to the position of the first shaft 62 (that is corresponding to the position of the mounting hole 621), and the inner wall of the first shaft 62 is provided with an internal thread (not shown, i.e., the inner wall of the mounting hole 621 is provided with an internal thread). The rod 631 is threadedly connected to the first shaft 62, so that the pin 63 is fixedly connected to the first shaft 62. The outer wall of the rod 631 corresponding to the position of the second shaft 51 (that is, corresponding to the position of the through hole 511) is a smooth structure (that is, no external thread is provided), allowing the second shaft 51 to rotate smoothly around the pin 63.

In another achievable manner, the pin 63 is a half tooth screw.

As shown in FIG. 12, in an achievable manner, the mounting hole 621 runs axially through the first shaft 62, and the distal end of the rod 631 (that is, the end far away from the stopping portion 632) does not extend to the outside of the mounting hole 621. In another achievable manner, the distal end of the rod 631 extends to the outside of the mounting hole 621, and a nut (not shown) is provided on the distal end of the rod 631 to further fix the pin 63 to the first shaft 62.

As shown in FIGS. 10 to 12, in an achievable manner, a corrugated gasket 54 is sleeved on the pin 63, and the corrugated gasket 54 abuts against one end face of the second shaft 51 that is away from the first shaft 62. Specifically, the corrugated gasket 54 is sleeved on the rod 631 of the pin 63, and the corrugated gasket 54 is clamped between the stopping portion 632 and the end face of the second shaft 51 that is away from the first shaft 62.

Specifically, the corrugated gasket 54, also known as a wave washer, is a circular thin sheet with a regular wavy shape. The corrugated gasket 54 not only can prevent the loosening of the pin 63 and slow down the impact, but also can increase the rotational resistance of the second shaft 51, slow down the rotational speed of the pillar 21 during rotation, increase the safety of use, and extend the service life of the components (to prevent the pillar 21 from rotating too fast and causing significant impact force between the first limiting structure 53 and the second limiting structure 64 when in contact). Also, the corrugated gasket 54 can avoid direct contact between the second shaft 51 and the stopping portion 632 to cause wear during rotation.

As shown in FIGS. 10 and 12, in an achievable manner, an accommodating groove 512 is provided in the end face of the second shaft 51 that is away from the first shaft 62, and the stopping portion 632 is accommodated in the accommodating groove 512, thereby improving the aesthetics and safety. The corrugated gasket 54 is clamped between the stopping portion 632 and the inner wall of the accommodating groove 512.

As shown in FIGS. 10 and 12, in an achievable manner, a first nylon gasket 66 is sleeved on the pin 63, and the first nylon gasket 66 is clamped between the second shaft 51 and the outer wall of the cover plate 65. By setting the first nylon gasket 66, on the one hand, it can prevent the second shaft 51 and/or the pillar 21 from directly contacting the cover plate 65 to cause rotational wear, and on the other hand, it can further increase the rotational resistance of the second shaft 51 and slow down the rotational speed of the pillar 21 during rotation.

As shown in FIGS. 10 and 12, in an achievable manner, a second nylon gasket 67 and a third nylon gasket 68 are sleeved on the first shaft 62, wherein the second nylon gasket 67 is clamped between the inner wall of the cover plate 65 and the limiting member 52, and the third nylon gasket 68 is clamped between the limiting member 52 and the inner wall of the base 61. On the one hand, the second nylon gasket 67 and the third nylon gasket 68 can increase the rotational resistance of the limiting member 52, thereby further slowing down the rotational speed of the pillar 21 during rotation; on the other hand, the second nylon gasket 67 and the third nylon gasket 68 can prevent the limiting member 52 from directly contacting the cover plate 65 and the base 61 to cause rotational wear.

Figure 14:
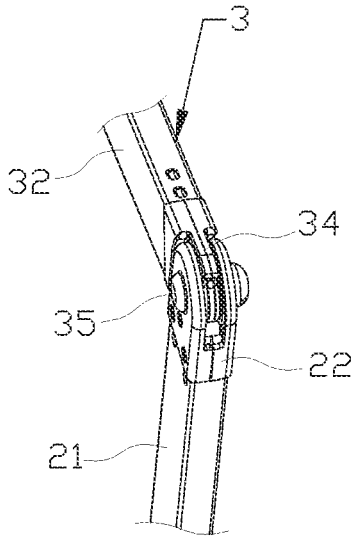
FIG. 14 is a schematic diagram of the assembly structure of the storage frame and the pillar in the embodiment of the present application.
Figure 15:
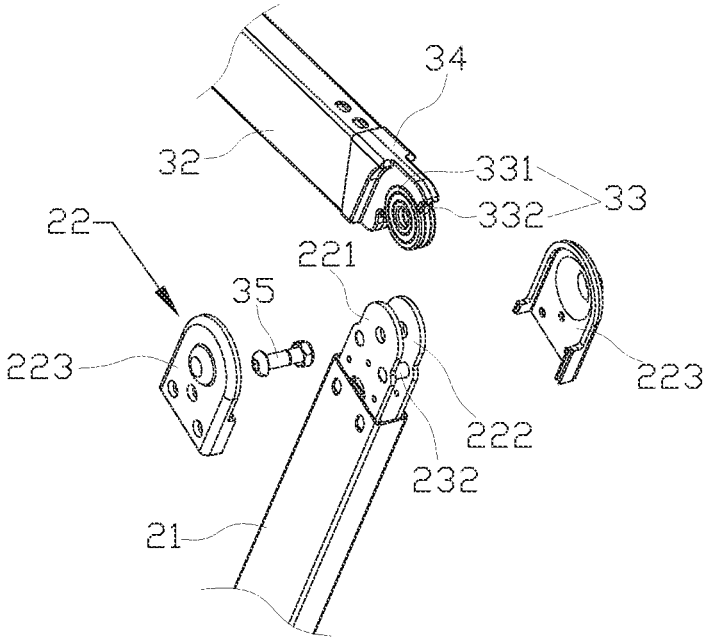
FIG. 15 is a schematic diagram of the explosive structure in FIG. 14.
Figure 16:
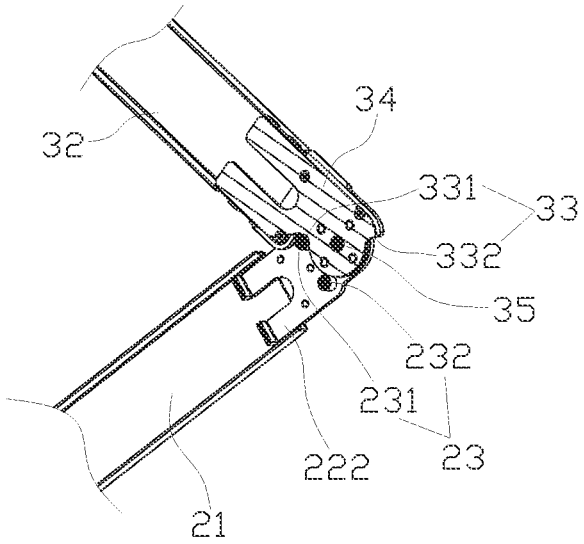
FIG. 16 is a cross-sectional schematic diagram of FIG. 14.

As shown in FIGS. 14 to 16, in an achievable manner, a third limiting structure 33 is provided on the storage frame 3, and a fourth limiting structure 23 is provided on the top end of the pillar 21. The fourth limiting structure 23 is used to cooperate with and abut against the third limiting structure 33, so that the storage frame 3 cannot continue to rotate after rotating to a specific position, so as to limit the storage frame 3 in position when the storage frame 3 is in the unfolded or folded state, prevent the storage frame 3 from continuing to rotate, and thus keep the storage frame 3 in the unfolded or folded state.

As shown in FIGS. 14 to 16, in an achievable manner, a first connecting member 34 is provided on the end of the side bar 32 of the storage frame 3, and a second connecting member 22 is provided on the top end of the pillar 21. The first connecting member 34 is rotatably connected to the second connecting member 22 through a rotation shaft 35 to achieve the rotational connection between the storage frame 3 and the pillar 21. The third limiting structure 33 is provided on the first connecting member 34, and the fourth limiting structure 23 is provided on the second connecting member 22. Specifically, the first connecting member 34 may be a separate component from the side bar 32 and is fixedly connected, for example, by welding, to the side bar 32, or the first connecting member 34 may be an integral part of the side bar 32. Similarly, the second connecting member 22 may be a separate component from the pillar 21 and is fixedly connected, for example, by welding, to the pillar 21, or the second connecting member 22 may be an integral part of the pillar 21.

As shown in FIGS. 14 to 16, in an achievable manner, the second connecting member 22 includes a first clamping plate 221 and a second clamping plate 222 which are oppositely disposed and spaced apart from each other. The first connecting member 34 is located between the first clamping plate 221 and the second clamping plate 222, and the rotation shaft 35 passes through the first clamping plate 221, the first connecting member 34, and the second clamping plate 222 simultaneously. The rotation shaft 35 can be a bolt. The fourth limiting structure 23 includes a first locking post 231 and a second locking post 232, which are arranged between the first clamping plate 221 and the second clamping plate 222. The first locking post 231 and the second locking post 232 are spaced apart from each other. Specifically, one end of the first locking post 231 is connected to the inner wall of the first clamping plate 221, the other end of the first locking post 231 is connected to the inner wall of the second clamping plate 222; one end of the second locking post 232 is connected to the inner wall of the first clamping plate 221, and the other end of the second locking post 232 is connected to the inner wall of the second clamping plate 222. The third limiting structure 33 includes a first locking groove 331 and a second locking groove 332, which are provided on the first connecting member 34. The first locking post 231 and the second locking post 232 can be respectively locked in the first locking groove 331 and the second locking groove 332, so as to limit the storage frame 3 in position when the storage frame 3 is in an unfolded or folded state.

Specifically, as shown in FIGS. 14 and 16, when the storage frame 3 is in the unfolded state, the first locking post 231 is engaged in the first locking groove 331, preventing the storage frame 3 from continuing to rotate counterclockwise (as viewed from FIG. 16), thereby limiting the storage frame 3 when it is in the unfolded state. When the storage frame 3 is in the folded state, the second locking post 232 is engaged in the second locking groove 332, preventing the storage frame 3 from continuing to rotate clockwise, thereby limiting the storage frame 3 when it is in the folded state. Of course, in other embodiments, the third limiting structure 33 and the fourth limiting structure 23 may also be other forms of structures.

As shown in FIGS. 14 and 15, in an achievable manner, the second connecting member 22 further includes two cover shells 223, and the two cover shells 223 are respectively provided on opposite sides of the first clamping plate 221 and the second clamping plate 222 to cover the first clamping plate 221 and the second clamping plate 222 and improve the aesthetics. The two cover shells 223 are fixedly connected to each other by screws.

Figure 17A:
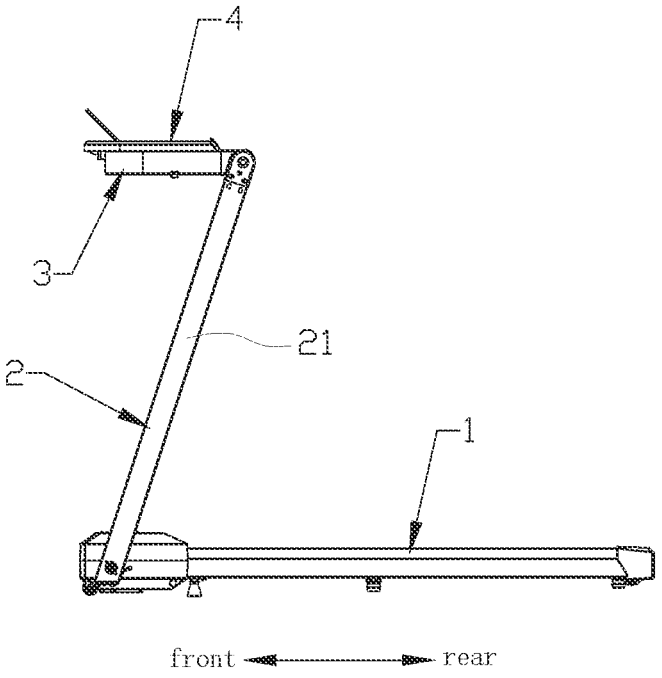
FIGS. 17*a* to 17*d* are schematic diagrams of the folding process of the foldable treadmill in the embodiment of the present application.

As shown in FIGS. 17*a* to 17*d*, in an achievable manner, the usage of the foldable treadmill can be as follows:

(1) As shown in FIG. 17*a*, when the foldable treadmill is in normal use, the foldable treadmill is in the unfolded state, the pillar assembly 2 is kept in a standing position, the storage frame 3 is kept in a horizontal position, and the storage platform 4 is installed on the storage frame 3.

Figure 17B:
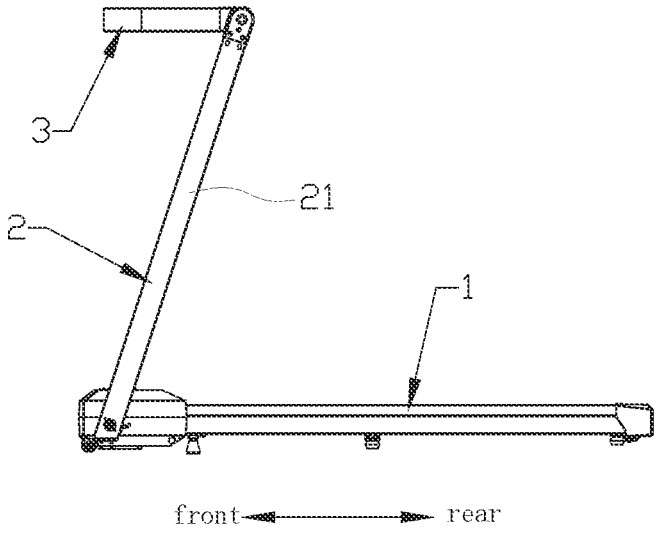
Figure 17C:
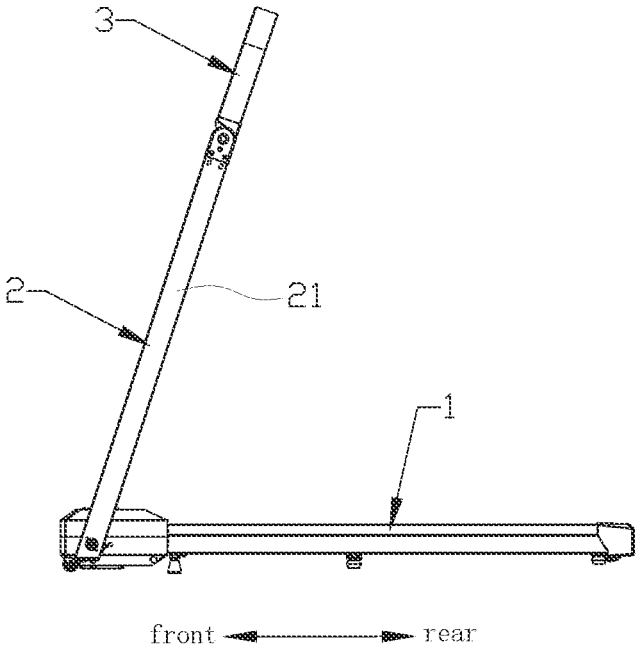
Figure 17D:
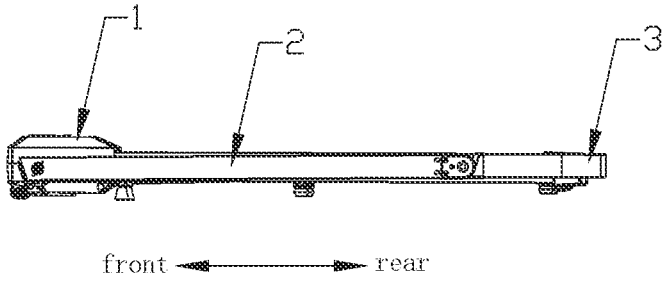

(2) As shown in FIGS. 17*b* to 17*d*, when folding the treadmill, the storage platform 4 is first removed from the storage frame 3, then the storage frame 3 is rotated backwards to make it in the same plane as the pillar assembly 2, the switch 7 is unlocked and then the storage frame 3 and the pillar assembly 2 are rotated together backwards, so that the storage frame 3 and the pillar assembly 2 are rotated to a horizontal position and stored on the sides of the treadmill body 1.

(3) When the treadmill needs to be reused, the folding steps mentioned above are reversed, that is, the pillar assembly 2 is rotated forward so that the pillar assembly 2 is rotated to a standing position, the switch 7 is then locked, thereafter the storage frame 3 is rotated forward to a horizontal position, and then the storage platform 4 is installed on the storage frame 3.

The foldable treadmill provided in the embodiments of the present application is provided with a storage frame 3 and a storage platform 4. The storage frame 3 is rotatably connected to the pillar assembly 2, and the storage platform 4 is detachably installed on the storage frame 3. When unfolding the foldable treadmill, the pillar assembly 2 is rotated to stay in a standing position, and the storage frame 3 is rotated to a horizontal position, so that the foldable treadmill is in an unfolded state. At this time, the storage platform 4 can be installed on the storage frame 3, and the users can place items such as mobile phones, tablets and so forth on the storage platform 4 to achieve the storage function of the treadmill. When folding the foldable treadmill, the storage platform 4 is first removed from the storage frame 3, and then, the storage frame 3 and the pillar assembly 2 are rotated to the sides of the treadmill body 1 to store the storage frame 3 and the pillar assembly 2, thereby achieving the folding and storage function of the treadmill. Moreover, during the folding process, the storage frame 3 is rotated to be in the same plane as the pillar assembly 2, thereby reducing the space occupied by the storage frame 3 in the folded state and facilitating folding. This foldable treadmill is not only provided with a storage platform 4 that can hold items such as mobile phones, tablets and so forth, but also has a folding function, making it convenient for the users to use.

The above are only the specific embodiments of the present application, but the scope of protection of the present application is not limited to this. Any technical personnel familiar with this technical field who can easily think of changes or replacements within the scope of technology disclosed in the present application should be covered within the scope of protection of the present application. Therefore, the protection scope of the present application should be based on the protection scope of the claims.

What is claimed is:

1. A foldable treadmill comprising a treadmill body (1), a pillar assembly (2), a storage frame (3), and a storage platform (4), wherein the storage platform (4) is detachably installed on the storage frame (3); the pillar assembly (2) comprises two pillars (21) located on left and right sides of the treadmill body (1), a bottom end of each pillar (21) is rotatably connected to a front end of the treadmill body (1), and the storage frame (3) is rotatably connected to top ends of the two pillars (21);

when the foldable treadmill is in an unfolded state, the pillar assembly (2) stays in a standing position, the storage frame (3) stays in a horizontal position and is used to install the storage platform (4); when the foldable treadmill is in a folded state, the storage platform (4) is removed from the storage frame (3), the storage frame (3) is rotated to be in a same plane as the pillar assembly (2), and both the storage frame (3) and the pillar assembly (2) are rotated to be stored on the left and right sides of the treadmill body (1);

wherein the storage frame (3) is a U-shaped structure, and the storage frame (3) comprises a crossbar (31) and two side bars (32) respectively connected to opposite ends of the crossbar (31), the two side bars (32) are respectively rotatably connected to the top ends of the two pillars (21); when the foldable treadmill is in the unfolded state, the storage frame (3), the pillar assembly (2) and the treadmill body (1) form a Z-shaped structure;

when the foldable treadmill is in the folded state, the crossbar (31) is stored on a rear side of the treadmill body (1), and the two pillars (21) and the two side bars (32) are stored on the left and right sides of the treadmill body (1);

wherein the storage platform (4) is provided with a clamping mechanism (40), and the clamping mechanism (40) is used to engage with the storage frame (3) to fix the storage platform (4) on the storage frame (3); and wherein the clamping mechanism (40) comprises a clamping slot (401) provided on a lower surface of the storage platform (4) and clamping claws (402) rotatably connected to the storage platform (4), the clamping claws (402) are arranged on the left and right sides of the storage platform (4); when the storage platform (4) is installed on the storage frame (3), the crossbar (31) is engaged in the clamping slot (401), and the clamping claws (402) are respectively hooked on the two side bars (32).

2. The foldable treadmill as claimed in claim 1, wherein a receiving groove (30) is enclosed by the crossbar (31) and the two side bars (32); when the storage platform (4) is installed on the storage frame (3), the storage platform (4) covers the receiving groove (30); when the storage platform (4) is removed from the storage frame (3), the receiving groove (30) is exposed.

3. The foldable treadmill as claimed in claim 1, wherein the storage platform (4) comprises a storage board (41) and a back plate (42) that is rotatably connected to the storage board (41), wherein there is an indentation (411) on the storage board (41); when the back plate (42) is in use, the back plate (42) is rotated and unfolded at a certain angle with respect to the storage board (41), and when the back plate (42) is not in use, the back plate (42) is rotated to be accommodated and stored in the indentation (411).

4. The foldable treadmill as claimed in claim 1, wherein the foldable treadmill further comprises two hinge assemblies (500) respectively corresponding to the two pillars (21), each hinge assembly (500) comprising a rotating assembly (5) and a fixing assembly (6), the bottom end of the corresponding pillar (21) is fixedly connected to the rotating assembly (5), the fixing assembly (6) is fixedly connected to the treadmill body (1), the rotating assembly (5) is rotatably connected to the fixing assembly (6), so that the rotating assembly (5) can rotate relative to the fixing assembly (6);

a first limiting structure (53) is provided on the rotating assembly (5), and a second limiting structure (64) is provided on the fixing assembly (6), the second limiting structure (64) is used to cooperate with and abut against the first limiting structure (53) to limit the corresponding pillar (21) in position when the corresponding pillar (21) is in an unfolded or folded state.

5. The foldable treadmill as claimed in claim 4, wherein each hinge assembly (500) further comprises a switch (7) configured for locking and unlocking the rotating assembly (5), the switch (7) is movably connected to the fixing assembly (6); when the corresponding pillar (21) is in the unfolded state, the switch (7) is engaged with the rotating assembly (5) to lock and maintain the corresponding pillar (21) in the unfolded state.

6. The foldable treadmill as claimed in claim 4, wherein the fixing assembly (6) comprises a base (61) being hollow and a first shaft (62) fixedly connected to the base (61), one end of the first shaft (62) is fixedly connected to the treadmill body (1), and another end of the first shaft (62) extends into the base (61);

the rotating assembly (5) comprises a second shaft (51) and a limiting member (52), the second shaft (51) is located on one side of the base (61), the second shaft (51) is fixedly connected to the bottom end of the corresponding pillar (21); the second shaft (51) is rotatably connected to the first shaft (62) through a pin (63), the limiting member (52) is located inside the base (61), the limiting member (52) is sleeved on the first shaft (62), and the limiting member (52) is fixedly connected to the corresponding pillar (21) and can rotate with the corresponding pillar (21);

the first limiting structure (53) is provided on an outer wall of the limiting member (52), the second limiting structure (64) is provided on an inner wall of the base (61), and the second limiting structure (64) is located on a rotation path of the first limiting structure (53).

7. The foldable treadmill as claimed in claim 6, wherein the first limiting structure (53) comprises a first limiting portion (531) and a second limiting portion (532) that are separately provided on the outer wall of the limiting member (52), the second limiting structure (64) comprises a first stopping portion (641) and a second stopping portion (642) that are separately provided on the inner wall of the base (61); when the corresponding pillar (21) is in the unfolded state, the first limiting portion (531) abuts against one side of the first stopping portion (641); when the corresponding pillar (21) is in the folded state, the second limiting portion (532) abuts against another side of the first stopping portion (641), and at a same time, the first limiting portion (531) abuts against the second stopping portion (642).

8. The foldable treadmill as claimed in claim 7, wherein the limiting member (52) is a circular plate structure, both the first limiting portion (531) and the second limiting portion (532) are formed by protruding radially outward from the outer wall of the limiting member (52); the base (61) is a circular structure, and both the first stopping portion (641) and the second stopping portion (642) are formed by protruding radially inward from the inner wall of the base (61).

9. The foldable treadmill as claimed in claim 6, wherein the pin (63) is fixedly connected to the first shaft (62), and the second shaft (51) is rotatable around the pin (63); or the pin (63) is fixedly connected to the second shaft (51), and the pin (63) is rotatably connected to the first shaft (62).

10. The foldable treadmill as claimed in claim 9, wherein the pin (63) comprises a rod (631) and a stopping portion (632) which are interconnected to each other, with an outer diameter of the stopping portion (632) greater than that of the rod (631), the rod (631) is inserted into both the second shaft (51) and the first shaft (62), one end of the rod (631) that is far away from the stopping portion (632) is fixedly connected to the first shaft (62), and the second shaft (51) can rotate around the rod (631).

11. The foldable treadmill as claimed in claim 10, wherein a through hole (511) is provided in the second shaft (51), the through hole (511) runs axially through the second shaft (51), a mounting hole (621) is axially provided in the first shaft (62); the rod (631) is inserted into the mounting hole (621) after passing through the through hole (511), an inner wall of the mounting hole (621) is provided with a first step (621*c*), an outer wall of the rod (631) is provided with a second step (631*c*), and the second step (631*c*) abuts against the first step (621*c*).

12. The foldable treadmill as claimed in claim 11, wherein the mounting hole (621) comprises a first inner hole (621*a*) and a second inner hole (621*b*) which are interconnected with each other, with the first inner hole (621*a*) located on one side of the second inner hole (621*b*) near the second shaft (51), wherein a diameter of the first inner hole (621*a*) is greater than that of the second inner hole (621*b*), and the first step (621*c*) is formed between the first inner hole (621*a*) and the second inner hole (621*b*); the rod (631) comprises a first rod section (631*a*) and a second rod section (631*b*) which are interconnected to each other, the first rod section (631*a*) is located between the stopping portion (632) and the second rod section (631*b*), an outer diameter of the first rod section (631*a*) is greater than that of the second rod section (631*b*), and the second step (631*c*) is formed between the first rod section (631*a*) and the second rod section (631*b*), the second rod section (631*b*) is received in the second inner hole (621*b*), one end of the first rod section (631*a*) near the second rod section (631*b*) is received in the first inner hole (621*a*), and another end of the first rod section (631*a*) that is away from the second rod section (631*b*) is received in the through hole (511).

13. The foldable treadmill as claimed in claim 6, wherein each hinge assembly (500) further comprises a switch (7) configured for locking and unlocking the rotating assembly (5), the switch (7) is rotatably connected to the base (61); the switch (7) comprises a locking portion (71) and a handle portion (72) which are interconnected to each other, the locking portion (71) is located inside the base (61), and the handle portion (72) extends to an outside of the base (61); the limiting member (52) is provided with a limiting groove (521), when the corresponding pillar (21) is in the unfolded state, the locking portion (71) is engaged with the limiting groove (521) to lock and maintain the corresponding pillar (21) in the unfolded state.

14. The foldable treadmill as claimed in claim 6, wherein an installation opening (611) configured to install the limiting member (52) into the base (61) is provided on one side of the base (61) facing the second shaft (51), wherein there is a cover plate (65) located at the installation opening (611) and fixedly connected to the base (61), the limiting member (52) is received in a space enclosed by the base (61) and the cover plate (65).

15. The foldable treadmill as claimed in claim 4, wherein a third limiting structure (33) is provided on an end of each of the two side bars (32) of the storage frame (3), and a fourth limiting structure (23) is provided on the top end of the corresponding pillar (21); the fourth limiting structure (23) is used to cooperate with and abut against the third limiting structure (33) to limit the storage frame (3) in position when the storage frame (3) is in an unfolded or folded state.

16. The foldable treadmill as claimed in claim 15, wherein a first connecting member (34) is provided on the end of the corresponding side bar (32) of the storage frame (3), a second connecting member (22) is provided on the top end of the corresponding pillar (21), the first connecting member (34) is rotatably connected to the second connecting member (22) through a rotation shaft (35), the third limiting structure (33) is provided on the first connecting member (34), and the fourth limiting structure (23) is provided on the second connecting member (22).

17. The foldable treadmill as claimed in claim 16, wherein the second connecting member (22) comprises a first clamping plate (221) and a second clamping plate (222) which are oppositely disposed and spaced apart from each other, the first connecting member (34) is located between the first clamping plate (221) and the second clamping plate (222), the fourth limiting structure (23) comprises a first locking post (231) and a second locking post (232) which are spaced apart from each other and arranged between the first clamping plate (221) and the second clamping plate (222), the third limiting structure (33) comprises a first locking groove (331) and a second locking groove (332) which are provided on the first connecting member (34), the first locking post (231) and the second locking post (232) can be respectively locked in the first locking groove (331) and the second locking groove (332).

* * * * *